US011193400B2

(12) United States Patent
Mlinaric

(10) Patent No.: US 11,193,400 B2
(45) Date of Patent: Dec. 7, 2021

(54) PRESSURIZED OIL RESERVOIR FOR CAMSHAFT PHASER

(71) Applicant: Schaeffler Technologies AG & Co. KG, Herzogenaurach (DE)

(72) Inventor: Andrew Mlinaric, Lakeshore (CA)

(73) Assignee: Schaeffler Technologies AG & Co. KG, Herzogenaurach (DE)

( * ) Notice: Subject to any disclaimer, the term of this patent is extended or adjusted under 35 U.S.C. 154(b) by 0 days.

(21) Appl. No.: 16/861,352

(22) Filed: Apr. 29, 2020

(65) Prior Publication Data

US 2021/0340888 A1 Nov. 4, 2021

(51) Int. Cl.
*F01L 1/344* (2006.01)

(52) U.S. Cl.
CPC ... *F01L 1/3442* (2013.01); *F01L 2001/34426* (2013.01); *F01L 2001/34479* (2013.01)

(58) Field of Classification Search
CPC ..... F01L 1/3442; F01L 1/344; F01L 2001/34426; F01L 2001/3443; F01L 1/34; F01L 2001/34433; F01L 2001/34479; F02D 2041/001
USPC ..... 123/90.17, 90.15, 90.16, 90.12
See application file for complete search history.

(56) References Cited

U.S. PATENT DOCUMENTS 6,763,791 B2 * 7/2004 Gardner ..... F01L 1/34 123/90.15
9,587,524 B2 * 3/2017 Bayrakdar ..... F01L 1/3442
10,156,165 B2 12/2018 Scheidig et al.
2005/0103297 A1 5/2005 Simpson
2005/0183682 A1 * 8/2005 Uozaki ..... F01L 1/3442 123/90.17
2010/0313834 A1 * 12/2010 Auchter ..... F01L 1/34 123/90.15
2010/0326385 A1 * 12/2010 Busse ..... F01L 1/3442 123/90.17
2013/0092113 A1 4/2013 Bohner et al.
2013/0199468 A1 * 8/2013 Schafer ..... F01L 1/3442 123/90.15
2018/0355767 A1 * 12/2018 Boese ..... F01L 1/047
2019/0107014 A1 4/2019 Smith
2020/0095906 A1 3/2020 Mlinaric

FOREIGN PATENT DOCUMENTS

CN 110318836 A1 10/2019
CN 110359976 A1 10/2019
CN 110360347 A1 10/2019
JP 2002235513 A 8/2002
JP 2012219815 A 11/2012

* cited by examiner

*Primary Examiner* — Patrick Hamo
*Assistant Examiner* — Wesley G Harris

(57) ABSTRACT

A camshaft phaser routes pressurized fluid from a set of chambers that are decreasing in volume to a reservoir. Oscillations of the rotor with respect to the stator create intervals in which the pressure in the reservoir exceeds the pressure in the set of chambers which are increasing in volume. During these intervals, fluid flows from the reservoir, through one-way valves, into the chambers which are increasing in volume. Pressurization of the reservoir increases the volume of flow through the one-way valves, decreasing the pump flow requirement for the camshaft phaser.

10 Claims, 6 Drawing Sheets

PRESSURIZED OIL RESERVOIR FOR CAMSHAFT PHASER

TECHNICAL FIELD

This invention is generally related to a camshaft phaser of an internal combustion (IC) engine.

BACKGROUND

FIG. 1 schematically illustrates a portion of a piston engine valve system. Crankshaft 10 rotates in response to combustion of fuel in cylinders. First sprocket 12 is fixed to the crankshaft 10. Second sprocket 14 is driven by the first sprocket 12 via chain 16. The relative sizes of sprockets 12 and 14 cause sprocket 14 to rotate once for every two revolutions of sprocket 12. Camshaft 18 is driven by sprocket 14 such that it rotates once for every two rotations of crankshaft 10. Cams on camshaft 18 actuate valves that permit flow of air/fuel mixture into cylinders and permit flow of combustion products out of cylinders at appropriate times during the power cycle.

In some engines, camshaft 18 is fixedly coupled to sprocket 14. In such systems, the valves open and close at the same crankshaft position regardless of operating condition. The engine designer must select valve opening and closing positions that provide acceptable performance in all operating conditions. This often requires a compromise between positions optimized for engine starting and for high speed operation.

To improve performance across variable operating conditions, some engines utilize a variable cam timing mechanism 20 that allows a controller to vary a rotational offset between sprocket 14 and camshaft 18.

SUMMARY

A camshaft phaser includes a stator, a rotor, first and second covers, a reservoir cover, and a valve assembly. The rotor is fixed to a camshaft. The first and second covers are fixed to the stator. The stator, rotor, and first and second covers define A-chambers and B-chambers such that a volume ratio between the A-chambers and the B-chambers varies as a function of a rotational position of the rotor relative to the stator. The reservoir cover forms a fluid reservoir with the first cover. The reservoir cover may be in sealing contact with the rotor. The reservoir cover may be rotationally fixed to the rotor and may slip with respect to the stator. The reservoir cover may define at least one orifice. The fluid reservoir is connected to the A-chambers and the B-chambers by one-way valves configured to permit flow from the fluid reservoir but not to the reservoir. The valve assembly configured to selectively direct pressurized fluid based on a position. In a first position, the valve assembly directs pressurized fluid from a fluid source to both the A-chambers and the B-chambers. In a second position, the valve assembly directs pressurized fluid from the fluid source to the A-chambers and directs pressurized fluid from the B-chambers to the reservoir. In a third position, the valve assembly directs pressurized fluid from the fluid source to the B-chambers and direct pressurized fluid from the A-chambers to the reservoir. In this context, directing pressurized fluid from a source to a sink means that the fluid is maintained at above atmospheric pressure throughout the entire route. The valve assembly may include a valve housing that extends through the rotor, in which case the reservoir cover may be clamped between the rotor and the valve housing. Fluid may flow from the valve assembly to the reservoir through passageways defined by the reservoir cover and radial grooves in the rotor. The valve assembly may include a hydraulic unit and a spool. The hydraulic unit may have a first port fluidly connected to a pressurized fluid source, a second port fluidly connected to the A-chambers, a third port fluidly connected to the B-chambers, and a fourth port fluidly connected to the reservoir. The spool may be within the hydraulic unit. The spool may have first, second, third, and fourth lands and may define an internal passageway connecting a space between the first and second lands to a space between the third and fourth lands. In the first position, the first, second, and third ports may be between the second and third lands and the fourth port may be between the third and fourth lands. In the second position, the first and second ports may be between the second and third lands and the third and fourth ports may be between the third and fourth lands. In the third position, the second port may be between the first and second lands, the first and third ports may be between the second and third lands, and the fourth port may be between the third and fourth lands.

A camshaft phaser includes a stator, a rotor, first and second covers, and a reservoir cover. The rotor is fixed to a camshaft. The first and second covers are fixed to the stator. The stator, rotor, and first and second covers define A-chambers and B-chambers wherein a volume ratio between the A-chambers and the B-chambers varies as a function of a rotational position of the rotor relative to the stator. The reservoir cover is fixed to the rotor and forms a fluid reservoir with the first cover. The fluid reservoir is connected to the A-chambers and the B-chambers by one-way valves configured to permit flow from the fluid reservoir but not to the reservoir.

A method of operating a camshaft phaser includes routing fluid to maintain a current cam timing and to adjust cam timing. The camshaft phaser includes a stator and a rotor defining a set of A-chambers and a set of B-chambers. A reservoir is connected to the A-chambers and the B-chambers by one-way valves. To maintain the current cam timing, pressurized fluid is routed from a pressurized fluid source to both the A-chambers and the B-chambers. To adjust cam timing in a first direction, fluid is routed from the pressurized fluid source to the A-chambers and routed under pressure from the B-chambers to the reservoir. To adjust cam timing in a second direction, fluid is routed from the pressurized fluid source to the B-chambers and fluid is routed, under pressure, from the A-chambers to the reservoir. Routing the fluid, under pressure, to the reservoir may include routing the fluid between grooves of the rotor and a reservoir cover fixed to the rotor. Routing fluid, under pressure, to the reservoir may also include routing the fluid through an internal passageway in a spool.

DETAILED DESCRIPTION OF EMBODIMENTS

Embodiments of the present disclosure are described herein. It should be appreciated that like drawing numbers appearing in different drawing views identify identical, or functionally similar, structural elements. Also, it is to be understood that the disclosed embodiments are merely examples and other embodiments can take various and alternative forms. The figures are not necessarily to scale; some features could be exaggerated or minimized to show details of particular components. Therefore, specific structural and functional details disclosed herein are not to be interpreted as limiting, but merely as a representative basis for teaching one skilled in the art to variously employ the embodiments. As those of ordinary skill in the art will understand, various features illustrated and described with reference to any one of the figures can be combined with features illustrated in one or more other figures to produce embodiments that are not explicitly illustrated or described. The combinations of features illustrated provide representative embodiments for typical applications. Various combinations and modifications of the features consistent with the teachings of this disclosure, however, could be desired for particular applications or implementations.

The terminology used herein is for the purpose of describing particular aspects only, and is not intended to limit the scope of the present disclosure. Unless defined otherwise, all technical and scientific terms used herein have the same meaning as commonly understood to one of ordinary skill in the art to which this disclosure belongs. Although any methods, devices or materials similar or equivalent to those described herein can be used in the practice or testing of the disclosure, the following example methods, devices, and materials are now described.

Figure 1:
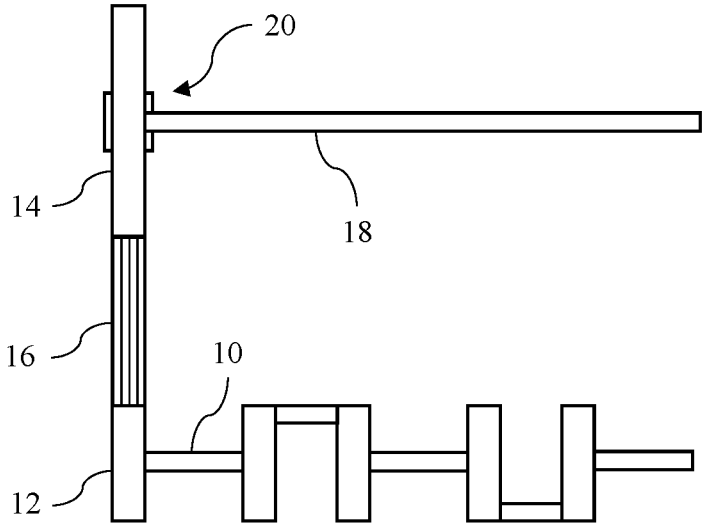
FIG. 1 (PRIOR ART)
FIG. 1 is a schematic illustration of a camshaft drive.
Figure 2:
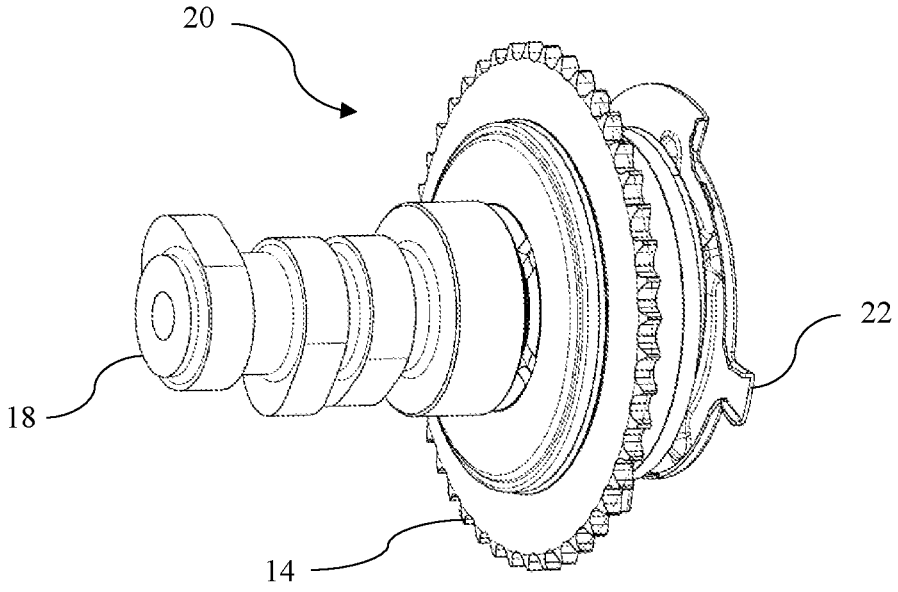
FIG. 2 is a pictorial view of a cam phaser and a camshaft.

FIG. 2 shows a variable valve timing mechanism 20 known as a cam phaser. Sprocket 14 is driven by the crankshaft via a chain. Camshaft 18 is driven by sprocket 14 with a phase offset determined by the cam phaser 20. Some types of cam phasers may include a timing wheel 22 fixed to the cam phaser rotor, enabling a sensor to accurately measure a current phase offset.

Figure 3:
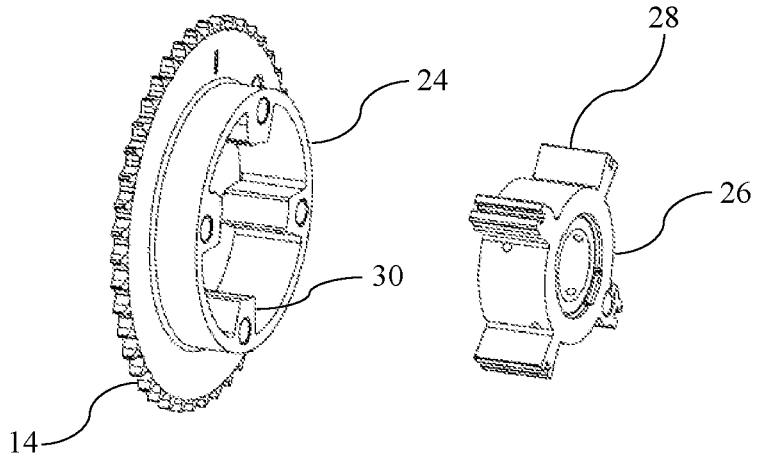
FIG. 3 is an exploded pictorial view of a stator and rotor of a cam phaser.

FIG. 3 shows two primary parts of the cam phaser mechanism in an exploded view. An oil control valve housing 25 extends through cam phaser 20 into camshaft 18. Stator 24 is fixed to sprocket 14. Rotor 26 is supported within stator 24. Vanes 28 of rotor 26 are interspersed circumferentially with internal radial protrusions 30 of stator 24 to define a number of chambers. The chambers on one side of the vanes are called A-chambers while the chambers on the opposite side of the vanes are called B-chambers. As the rotor 26 rotates in a first direction (e.g. clockwise) with respect to stator 24, the volume of the A-chambers increases and the volume of the B-chambers decreases. Conversely, as the rotor 26 rotates in a second direction (e.g. counter-clockwise) with respect to stator 24, the volume of the A-chambers decreases and the volume of the B-chambers increases. As will be discussed later, this relationship is used to adjust the rotational position of the rotor with respect to the stator by supplying fluid at differing pressures to the A-chambers and B-chambers. High pressure fluid is forced into one set of chambers causing the volume to increase while fluid at a lower pressure is allowed to flow out of the opposite chambers as their volume decreases.

The axial ends of the chambers are defined by a front cover 32 and 1 rear cover 34 (shown in later Figures) which are fixed to stator 24 by bolts. In this context, the side facing away from the camshaft is called the front and the side toward the camshaft is called the back, regardless of which end of the engine the assembly is located on or how the engine is positioned within the vehicle. Additional features and components secure the rotor to the front cover in the absence of hydraulic pressure.

Figure 4:
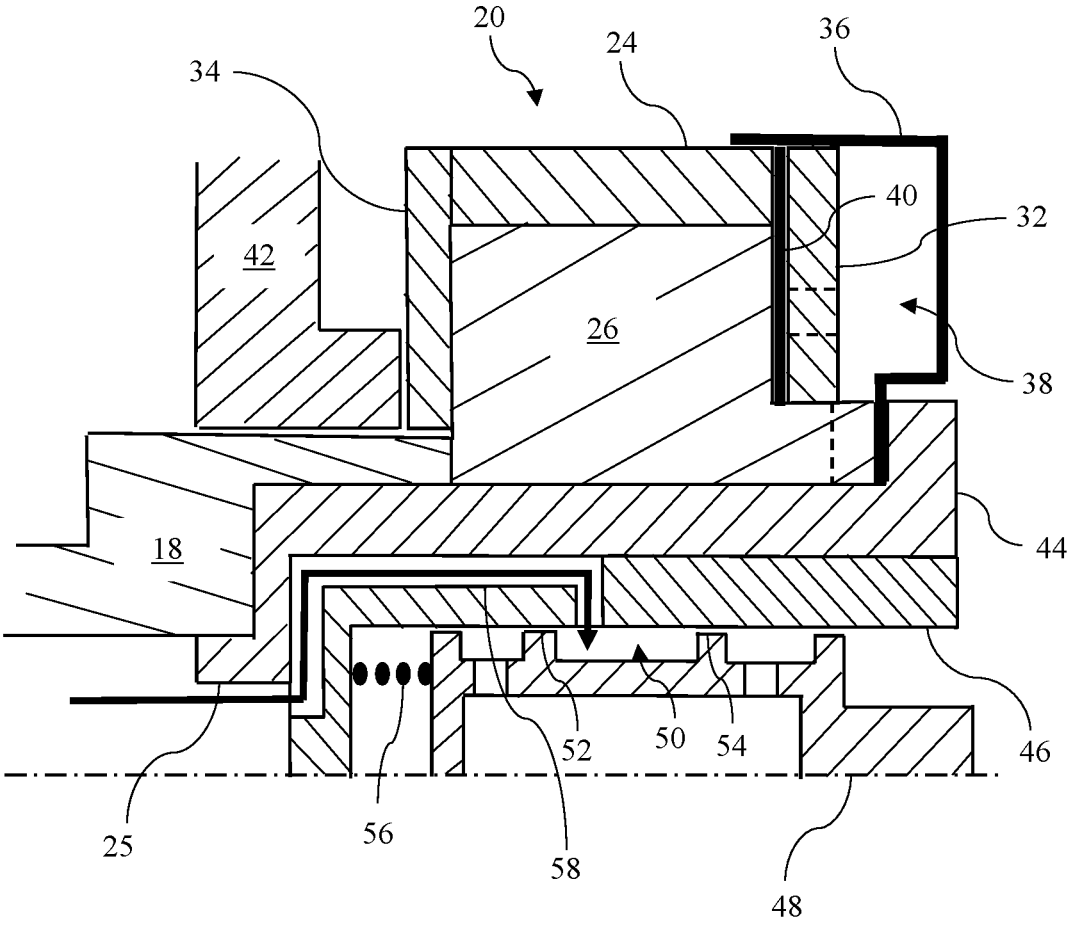
FIG. 4 is a first cross section view of the cam phaser.

FIG. 4 is a conceptual cross-section of the cam phaser adjustment mechanism 20. Parts are not necessarily drawn to scale but are rather drawn to facilitate illustration of the functionality. The cross-section of FIG. 4 is taken at a circumferential location which illustrates how pressurized fluid is supplied to the oil control valve. Some features are axisymmetric, but others are not.

Reservoir cover 36 connects to the front of the stator and, together with front cover 32, creates a fluid reservoir 38. Check valve plate 40 is sandwiched between the front cover 32 and the stator 24. Holes in the front cover and features of the check valve plate create a one-way flow path from the reservoir 38 to the A-chambers and B-chambers. If the pressure in one of the chambers falls below the pressure in the reservoir, fluid flows from the reservoir to the low-pressure chamber. This can occur, for instance, when torque exerted on the camshaft by the valvetrain momentarily accelerates the camshaft causing an acceleration of the cam phaser rotor and a pressure drop in the A-chamber or B-chamber. When the pressure drops below the pressure in the reservoir, oil flows from the reservoir to fill the chamber, preventing further pressure drop. Preventing a vacuum from forming in the chambers makes the adjustment faster, more controllable, and prevents noise.

The cam phaser and one end of the camshaft are supported by a mount 42 which is either part of the engine case or fixed to the engine case. Rotor 26 is fixed to camshaft 18, either directly or via intermediate components. Stator 24 is fixed to front cover 32 and rear cover 34. Oil control valve housing 44 is fixed to camshaft 18 and extends through rotor 26, which is hollow. Reservoir cover 36 is clamped between rotor 26 and oil control valve housing 44. Camshaft 18, oil control valve housing 44, rotor 26, and reservoir cover 36 all rotate as a unit, having substantially the same rotational speed and rotational position, subject to slight shaft twist due to torsional compliance. Similarly, stator 24, rear cover 34, check valve plate 40, and front cover 32 all rotate as a unit.

Hydraulic unit 46 fits within hollow oil control valve housing 44 and rotates therewith. Spool 48 fits within hydraulic unit 46. A feed cavity 50 is formed between hydraulic unit 46 and spool 48 between lands 52 and 54 of spool 48. Spring 56 biases spool 48 toward the front with respect to hydraulic unit 46. A solenoid (not shown) pushes spool 48 toward the rear against spring 56 in response to electrical current. The axial location of spool 48 is controlled by adjusting the magnitude of the electrical current. At the circumferential location illustrated in FIG. 4, fluid passageway 58 is formed between hydraulic unit 46 and oil control valve housing 44. Passageway 58 directs pressurized fluid from a hollow core of camshaft 18 into cavity 50.

Figure 5:
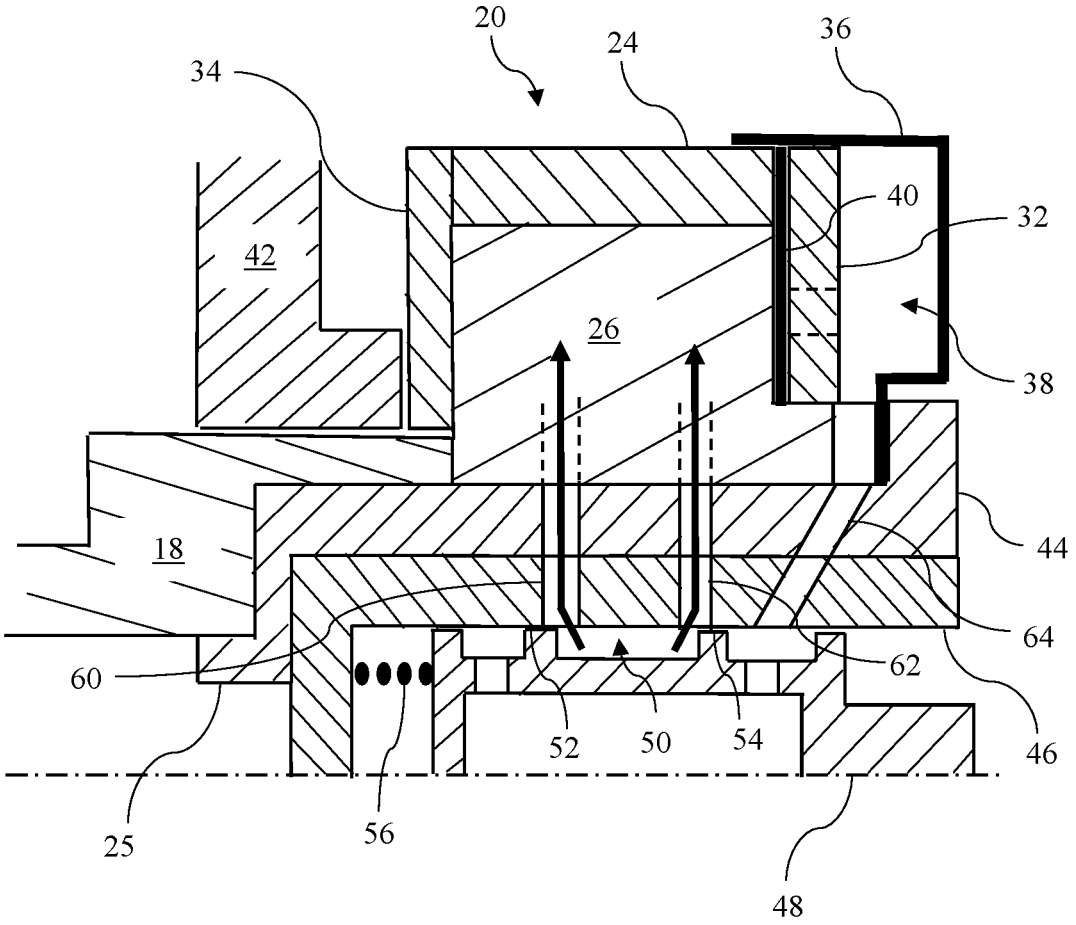
FIG. 5 is a second cross section view of the cam phaser during steady state operation.
Figure 6:
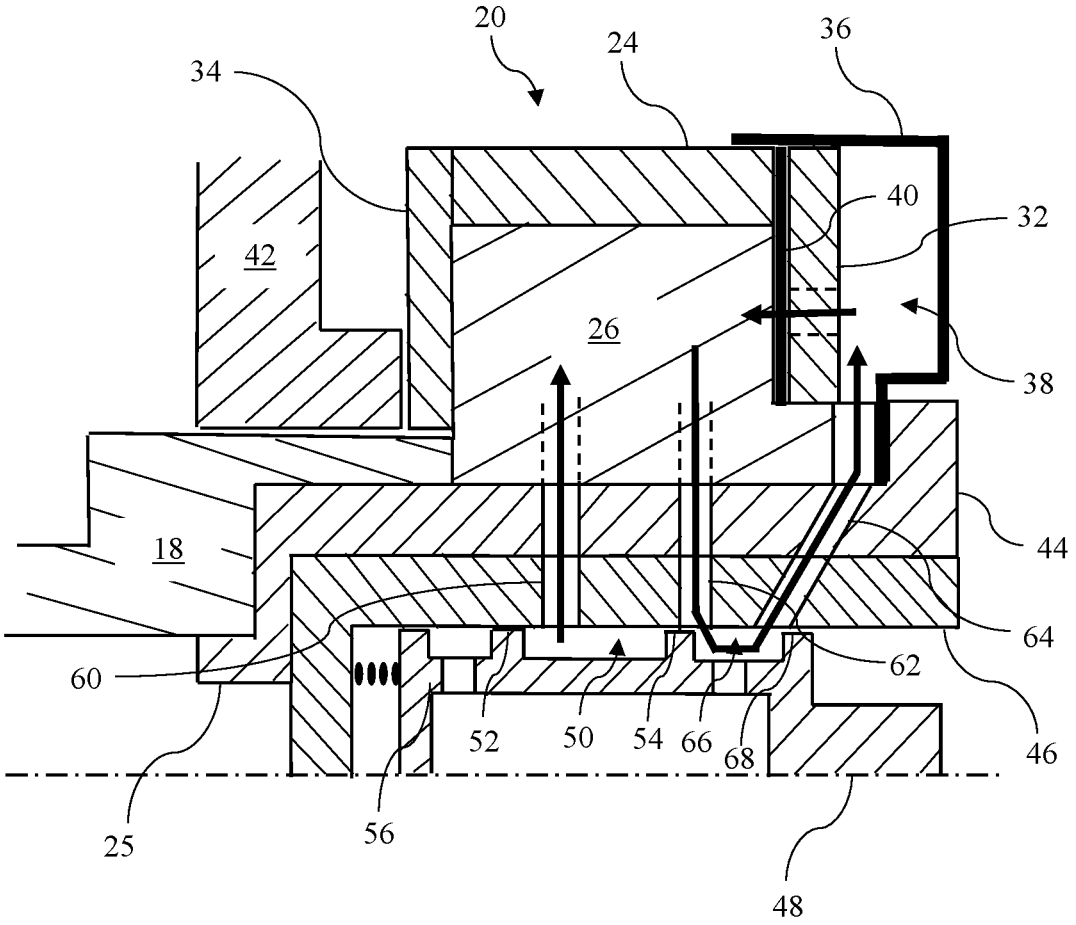
FIG. 6 is a second cross section view of the cam phaser during adjustment in a first direction.
Figure 7:
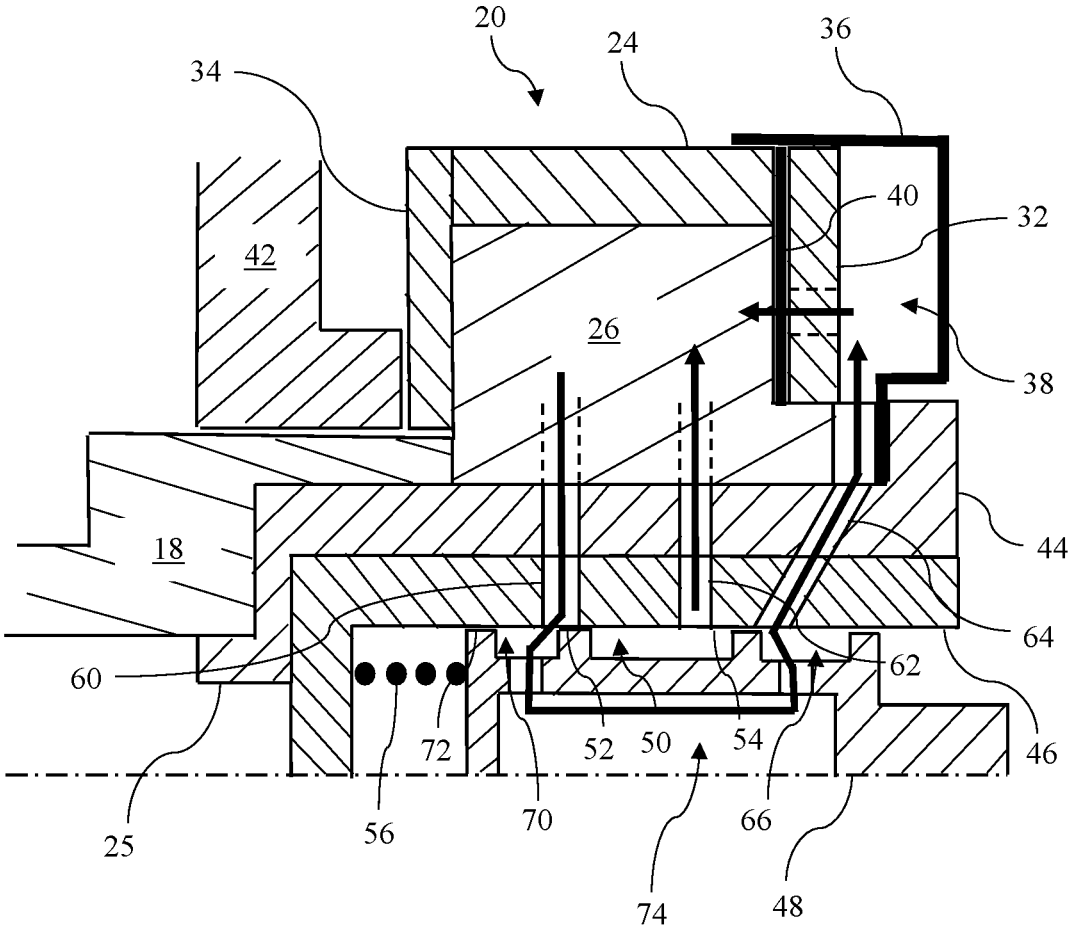
FIG. 7 is a second cross section view of the cam phaser during adjustment in a second direction.

FIGS. 5-7 are conceptual cross-sections of the cam phase adjustment mechanism taken at a different circumferential location than the cross section of FIG. 4. For example, the cross sections of FIG. 5-7 may be in a plane that is offset by 90 degrees from the cross section of FIG. 4. Several fluid passageways are formed at the circumferential location of FIGS. 5-7. Fluid passageway 60 extends through hydraulic unit 46, oil control valve housing 44, and rotor 26 into each of the A-chambers. Similarly, fluid passageway 62 extends through hydraulic unit 46, oil control valve housing 44, and rotor 26 into each of the B-chambers. Finally, fluid passageway 64 extends through hydraulic unit 46, oil control valve housing 44, and rotor 26 into reservoir 38. The final segment of passageway 62 is formed by grooves in rotor 26 and one side of reservoir cover 36.

FIG. 5 illustrates the position of spool 48 during steady state operation with rotor 26 remaining in a constant rotational position relative to stator 24. Pressurized fluid flows to both the A-chambers via passageway 60 and to the B-chambers via passageway 62.

FIG. 6 illustrates the position of spool 48 while rotor 26 is being actively rotated in the second direction (e.g. counter-clockwise) relative to stator 24. Spool 48 is moved to this position by increasing the magnetic force exerted by the solenoid such that spring 56 compresses, allowing spool 48 to move leftward. In this condition, pressurized fluid is supplied to the B-chambers via cavity 50 and passageway 60. Fluid in the A-chambers is released into passageway 62 from which it flows into a chamber 66 between lands 54 and 68. From chamber 66, the fluid flows via passageway 64 to reservoir 38. Since the fluid is being actively pushed out of the A-chambers by movement of rotor 26, the pressure in reservoir 38 is greater than ambient pressure. The valvetrain exerts a variable torque on the camshaft 18 as valves open and close, resulting in movement of rotor 26 relative to stator 24 being uneven. During some phases, the movement of rotor 26 may be fast enough that the pressure in the B-chambers drops below the pressure in reservoir 38. During these times, fluid flows into the B-chambers via the one-way valves in valve plate 40. This reduces the average flow rate of fluid into the B-chambers from chamber 50. That is advantageous because it permits use of a smaller pump with less drag, improving fuel efficiency. The pressure in chamber 66 pushes some fluid out the small gap between land 68 and hydraulic unit 46. Also, the pressure in reservoir 38 pushes some fluid out between reservoir cover 36 and stator 24. If these natural gaps excessively constrain the flow rate out the A-chambers, then additional intentional orifices of suitable size may be formed in reservoir cover 36.

FIG. 7 illustrates the position of spool 48 while rotor 26 is being actively rotated in the first direction (e.g. clockwise) relative to stator 24. Spool 48 is moved to this position by decreasing the electrical current to the solenoid such that the solenoid spring 56 pushes spool 48 rightward. A cavity 70 is formed between hydraulic unit 46 and spool 48 between lands 52 and 72. A hole connects cavity 70 to a hollow core 74 of spool 48, which in turn is connected to cavity 66 by another hole. From chamber 66, the fluid flows via passageway 64 to reservoir 38. Since the fluid is being actively pushed out of the B-chambers by movement of rotor 26, the pressure in reservoir 38 is greater than ambient pressure. Due to variable valvetrain torque, the movement of rotor 26 may be fast enough at times that the pressure in the A-chambers drops below the pressure in reservoir 38. During these times, fluid flows into the A-chambers via the one-way valves in valve plate 40. As described above, this reduces the average flow rate of fluid into the A-chambers from chamber 50.

In conventional cam phasers, fluid expelled from the A-chambers or B-chambers as they decrease in volume is expelled to ambient pressure. From there, some portion of the fluid is captured in the reservoir and slightly pressurized by centrifugal force as the assembly spins. With the reservoir 38 actively pressurized, the portion of time in which fluid flows into the chambers through the one-way valve is increased.

While exemplary embodiments are described above, it is not intended that these embodiments describe all possible forms encompassed by the claims. The words used in the specification are words of description rather than limitation, and it is understood that various changes can be made without departing from the spirit and scope of the disclosure. As previously described, the features of various embodiments can be combined to form further embodiments that may not be explicitly described or illustrated. While various embodiments could have been described as providing advantages or being preferred over other embodiments or prior art implementations with respect to one or more desired characteristics, those of ordinary skill in the art recognize that one or more features or characteristics can be compromised to achieve desired overall system attributes, which depend on the specific application and implementation. As such, to the extent any embodiments are described as less desirable than other embodiments or prior art implementations with respect to one or more characteristics, these embodiments are not outside the scope of the disclosure and can be desirable for particular applications.

What is claimed is:

1. A camshaft phaser comprising:

a stator;

a rotor fixed to a camshaft;

first and second covers fixed to the stator;

the stator, rotor, and first and second covers defining A-chambers and B-chambers wherein a volume ratio between the A-chambers and the B-chambers varies as a function of a rotational position of the rotor relative to the stator;

a reservoir cover forming a fluid reservoir with the first cover, the reservoir cover fixed for rotation with the rotor and permitted to rotate relative to the stator, the fluid reservoir connected to the A-chambers and the B-chambers by one-way valves configured to permit flow from the fluid reservoir but not to the fluid reservoir; and a valve assembly configured to in a first position, direct pressurized fluid from a fluid source to both the A-chambers and the B-chambers, in a second position, direct pressurized fluid from the fluid source to the A-chambers and direct fluid from the B-chambers to the fluid reservoir at greater than atmospheric pressure, and in a third position, direct pressurized fluid from the fluid source to the B-chambers and direct fluid from the A-chambers to the fluid reservoir at greater than atmospheric pressure.

2. The camshaft phaser of claim 1 wherein the reservoir cover is in sealing contact with the rotor.

3. The camshaft phaser of claim 1 wherein:

the rotor is hollow;

the valve assembly includes a valve housing that extends through the rotor; and the reservoir cover is clamped between the rotor and the valve housing.

4. The camshaft phaser of claim 1 wherein fluid flows from the valve assembly to the reservoir through passageways defined by the reservoir cover and radial grooves in the rotor.

5. The camshaft phaser of claim 1 wherein the valve assembly comprises:

a hydraulic unit having a first port fluidly connected to a pressurized fluid source, a second port fluidly connected to the A-chambers, a third port fluidly connected to the B-chambers, and a fourth port fluidly connected to the reservoir; and a spool within the hydraulic unit, the spool having first, second, third, and fourth lands and defining an internal passageway connecting a space between the first and second lands to a space between the third and fourth lands, wherein:

in the first position, the first, second, and third ports are between the second and third lands and the fourth port is between the third and fourth lands, in the second position, the first and second ports are between the second and third lands and the third and fourth ports are between the third and fourth lands, and in the third position, the second port is between the first and second lands, the first and third ports are between the second and third INTERNAL lands, and the fourth port is between the third and fourth lands.

6. The camshaft phaser of claim 1 wherein:

the first cover is located on a front of the stator facing away from cams on the camshaft; and the second cover is located on a back of the stator facing towards cams on the camshaft.

7. A camshaft phaser comprising:

a stator;

a rotor fixed to a camshaft;

first and second covers fixed to the stator;

the stator, rotor, and first and second covers defining A-chambers and B-chambers wherein a volume ratio between the A-chambers and the B-chambers varies as a function of a rotational position of the rotor relative to the stator; and a reservoir cover rotationally fixed to the rotor and forming a fluid reservoir with the first cover, the fluid reservoir connected to the A-chambers and the B-chambers by one-way valves configured to permit flow from the fluid reservoir but not to the fluid reservoir.

8. The camshaft phaser of claim 7 further comprising a valve assembly configured to:

in a first position, direct pressurized fluid from a fluid source to both the A-chambers and the B-chambers;

in a second position, direct pressurized fluid from the fluid source to the A-chambers and direct pressurized fluid from the B-chambers to the fluid reservoir; and in a third position, direct pressurized fluid from the fluid source to the B-chambers and direct pressurized fluid from the A-chambers to the fluid reservoir.

9. The camshaft phaser of claim 8 wherein:

the rotor is hollow;

the valve assembly includes a valve housing that extends through the rotor; and the reservoir cover is clamped between the rotor and the valve housing.

10. The camshaft phaser of claim 8 wherein fluid flows from the valve assembly to the fluid reservoir through passageways defined by the reservoir cover and radial grooves in the rotor.

* * * * *